US008322139B2

(12) United States Patent
Takahashi et al.

(10) Patent No.: US 8,322,139 B2
(45) Date of Patent: Dec. 4, 2012

(54) CONDENSER AND STEAM TURBINE POWER PLANT

(75) Inventors: Fumio Takahashi, Hitachi (JP); Akihito Suzuki, Hitachi (JP); Yasuyuki Kawasato, Kitaibaraki (JP); Shuuichi Imazu, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 833 days.

(21) Appl. No.: 12/468,549

(22) Filed: May 19, 2009

(65) Prior Publication Data

US 2009/0293478 A1 Dec. 3, 2009

(30) Foreign Application Priority Data

May 23, 2008 (JP) ..... 2008-135637

(51) Int. Cl.
*F01K 17/00* (2006.01)

(52) U.S. Cl. ..... 60/686; 60/693; 60/694

(58) Field of Classification Search ..... 60/685, 60/686, 690, 693, 394
See application file for complete search history.

(56) References Cited

U.S. PATENT DOCUMENTS

| | | | | |
|---|---|---|---|---|
| 2,781,640 A | | 2/1957 | Riehl | |
| 3,666,246 A | | 5/1972 | Cohen | |
| 4,165,616 A | * | 8/1979 | Pierpoline | 60/686 |
| 4,628,212 A | * | 12/1986 | Uehara et al. | 290/54 |
| 4,753,077 A | * | 6/1988 | Rosenblatt | 60/661 |
| 5,203,159 A | * | 4/1993 | Koizumi et al. | 60/773 |
| 6,012,290 A | * | 1/2000 | Garcia | 60/676 |
| 6,233,941 B1 | * | 5/2001 | Youssef | 60/670 |

FOREIGN PATENT DOCUMENTS

| | | |
|---|---|---|
| DE | 30 11 340 A1 | 10/1981 |
| GB | 1 248 436 | 10/1971 |
| JE | 8-21205 A | 1/1996 |
| JP | 56-3885 A | 1/1981 |
| JP | 3-71267 U | 7/1991 |
| JP | 2007-107761 A | 4/2007 |

* cited by examiner

*Primary Examiner* — Hoang Nguyen
(74) *Attorney, Agent, or Firm* — Mattingly & Malur, PC

(57) ABSTRACT

A condenser that restrains fluctuations in the condenser vacuum in a power generating installation.

In particular, the condenser has a circulating path through which cooling water flows; a tube nest for condensing steam from a steam turbine with the cooling water; and a discharge path. Additionally, a bypass tube; a control valve for controlling the flow rate of the cooling water supplied from the circulating path to the discharge path; a recirculating path; and a booster pump that controls the flow rate of the cooling water are provided. One of the temperature, the flow rate and both the temperature and the flow rate of the cooling water to flow through the two tube nests is deviated from the temperature and the flow rate of the cooling water on the upstream side of the circulating path using the control valve and booster pump.

16 Claims, 8 Drawing Sheets

CONDENSER AND STEAM TURBINE POWER PLANT

BACKGROUND OF THE INVENTION

1. Field of the Invention

The present invention relates to a condenser and a power generating installation using the condenser, wherein the condenser is used for maintaining the discharge pressure of a steam turbine.

2. Description of the Related Art

A condenser is used to condense saturated steam discharged from the final stage of a steam turbine to maintain the discharge pressure at vacuum. The condenser is provided with a number of cooling tubes. Steam led to the condenser is condensed on the outside surface of the cooling tubes. Cooling water introduced into the cooling tubes, such as the sea water, water from a cooling tower, etc. draws condensation latent heat from the steam to maintain the discharge pressure at vacuum. However, when the temperature of cooling water varies due to change in season, etc., the condensation temperature and saturated steam pressure may also change, resulting in vacuum of the condenser (condenser vacuum) fluctuating.

The output of the steam turbine changes with the vacuum of the condenser. A decrease in the vacuum (that is, an increase in the saturated steam pressure) reduces heat drop which passes through a turbine stage, resulting in reduced output of the steam turbine. On the other hand, there is a tendency that an increase in the vacuum increases heat drop and thus the output of the steam turbine is improved. However, when the axial velocity of the final stage of the turbine reaches the acoustic velocity because of an increase in the specific volume of steam, the power obtained by the turbine will be saturated. Thereafter, even when the vacuum is more increased the turbine output will improve no longer. When the vacuum is increased after the power is saturated in this way, the condensed liquid temperature falls and the heat required for re-heating increases, thus decreasing the output of the steam turbine as a system. For these reasons, there exists, in a power plant, condenser vacuum (hereinafter referred to as optimal vacuum) at which the output is maximized.

However, there has been a problem that the condenser vacuum is not necessarily maintained in such a manner that the maximum output is obtained since the condenser vacuum changes with seasonal variation of the cooling-water temperature, etc. as mentioned above. With one technique intended to solve the above-mentioned problem, the number of a plurality of cooling-water pumps under operation is changed to control the quantity of water taken from a water source (for example, the sea) to control the quantity of cooling water supplied to the condenser, thus optimizing the vacuum (refer, for example, to JP-A-2007-107761).

SUMMARY OF THE INVENTION

Meanwhile, various cooling-water conditions are imposed on a power plant depending on its location conditions. For example, when the sea water is used as cooling water, there are limitations on upper limits of the quantity of the sea water taken and of increase in the cooling-water temperature from the viewpoint of environmental protection. Further, an allowable lower limit of the flow velocity of the cooling water in the cooling tubes is set in order to maintain the cleanliness of the heat transfer surface. Therefore, even if the above-mentioned technique is used, these conditions need to be satisfied. In actuality, when the vacuum is to be maintained by controlling the quantity of water taken, adjustment can be achieved only within a small range.

An object of the present invention is to provide a condenser that can restrain fluctuations in the condenser vacuum while satisfying cooling-water conditions, and a power generating installation using the condenser.

In order to attain the above-mentioned object, the present invention provides a condenser used for a steam turbine power plant, comprising:

a circulating path through which cooling water taken from a water source flows;

a tube nest including a plurality of cooling tubes through which the cooling water coming from the circulating path flow, the tube nest condensing steam supplied from a steam turbine with the cooling water in the plurality of cooling tubes;

a discharge path through which the cooling water discharged from the tube nest flows;

a bypass tube disposed to bridge between the circulating path and the discharge path;

flow rate control means disposed in the bypass tube for controlling the flow rate of the cooling water supplied from the circulating path to the discharge path;

a recirculating path disposed to bridge between the discharge path and the circulation tube; and boosting means disposed in the recirculating path for controlling the flow rate of the cooling water supplied from the discharge path to the circulating path;

wherein, when water temperature in the water source changes, at least one of the temperature and the flow rate of the cooling water to flow through the tube nest is deviated from the temperature and the flow rate of the cooling water coming from the water source by the flow rate control means and the boosting means.

In accordance with the present invention, even when the cooling-water temperature in the water source changes, fluctuations in the condenser vacuum can be restrained while the quantity of water taken and discharge water temperature are maintained constant, thus preventing the output of the power plant from decreasing.

DESCRIPTION OF THE PREFERRED EMBODIMENTS

Embodiments of the present invention will be explained below with reference to the accompanying drawings.

Figure 1:
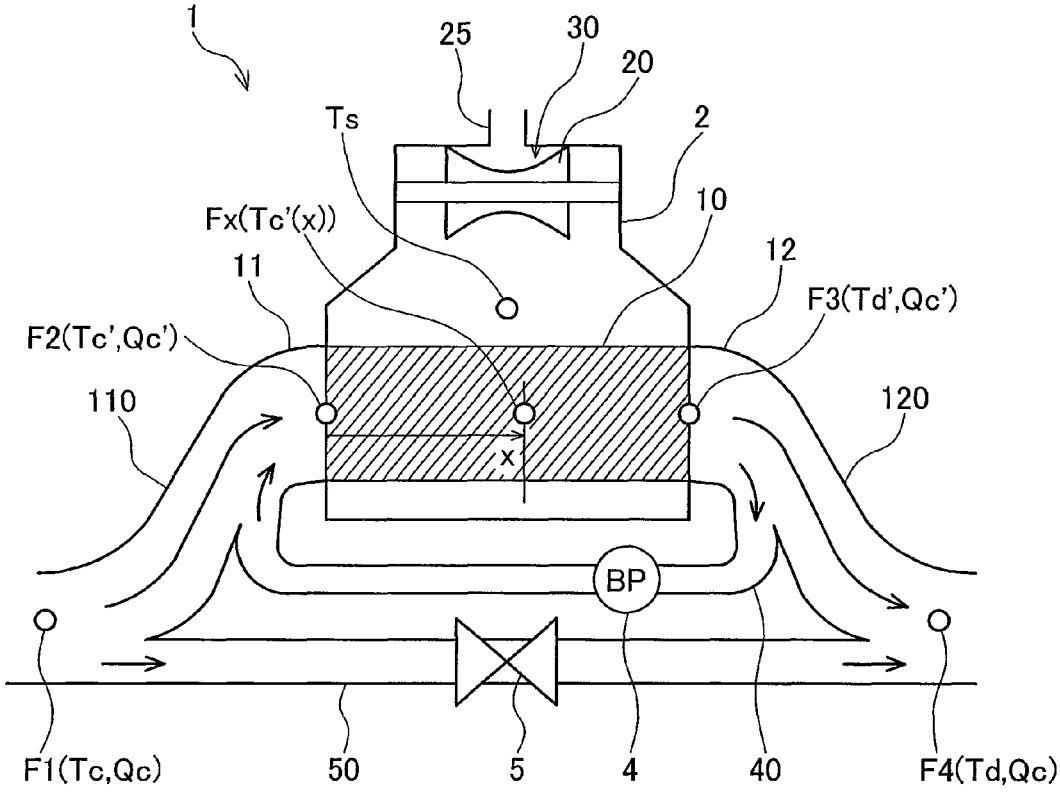
FIG. 1 is shows the general configuration of a condenser according to a first embodiment of the present invention.

FIG. 1 is the general configuration of a condenser according to a first embodiment of the present invention.

A condenser 1 shown in FIG. 1 includes a circulating path 110, a tube nest 10, a discharge path 120, a bypass tube 50, a control valve (flow rate control means) 5, a recirculating path 40, and a booster pump (boosting means) 4.

Cooling water taken from a water source flows through the circulating path 110, which is connected with a water source such as the sea or cooling water for a cooling tower. The cooling water flowing in the circulating path 110 is pumped up from the water source by a pump (not shown). The cooling water discharged from the tube nest 10 flows through the discharge path 120 whose downstream side is connected with the water source.

The tube nest 10 is composed of a plurality, several thousands for example, of cooling tubes so as to cool and condense steam from a steam turbine (Low pressure turbine) 30. Each of the plurality of cooling tubes constituting the tube nest 10 is connected with the circulating path 110 through an entrance water box 11 provided on the upstream side in the direction in which the cooling water flows. Each cooling tube is supplied with the cooling water from the circulating path 110. Further, the cooling tubes are connected with the discharge path 120 through an exit water box 12 provided on the downstream side in the direction in which the cooling water flows. The cooling tubes discharge the cooling water used to cool steam to the discharge path 120.

The bypass tube 50 is provided to bridge between the circulating path 110 and the discharge path 120. Cooling water flows through the bypass tube 50 from the circulating path 110 to the discharge path 120 so as to bypass part of the cooling water flowing in the circulating path 110 to the discharge path 120 without sending it to the tube nest 10. The cooling water having passed through the bypass tube 50 is mixed with another cooling water subjected to heat exchange, without being subjected to heat exchange by the tube nest 10.

A control valve (flow rate control means) 5 is provided on the bypass tube 50 to control the flow rate of the cooling water being bypassed from the circulating path 110 to the discharge path 120. When the control valve 5 is opened, it is possible to reduce the quantity of the cooling water supplied to the tube nest 10 in comparison with the quantity of water taken from the water source through the circulating path 110. It should be noted that even when the control valve 5 is opened, the quantity of water finally discharged to outside remains the same as the quantity of water taken since the bypassed cooling water joins with the discharged cooling water in the discharge path 120.

The recirculating path 40 is provided to bridge between the discharge path 120 and the circulating path 110. Cooling water flows through the recirculating path 40 from the discharge path 120 to the circulating path 110 to return part of the cooling water flowing in the discharge path 120 which passed through the tube nest 10 to the circulating path 110 without discharging it outside. In order to efficiently use the heat of the cooling water heated by steam, the recirculating path 40 according to the present embodiment is connected on the side closer to the tube nest 10 than the position where the bypass tube 50 is connected between the circulating path 110 and the discharge path 120. Since the present embodiment configures a closed loop with the recirculating path 40 and the bypass tube 50 as mentioned above, the cooling-water temperature when discharged to the water source remains the same as the conventional one.

The booster pump (boosting means) 4 is provided on the recirculating path 40 to control the flow rate of the cooling water being returned from the discharge path 120 to the circulating path 110. The booster pump 4 controls the flow rate of the cooling water flowing in the recirculating path 40 while boosting the cooling water pressure on the side of the discharge path 120 (on the downstream side) to the pressure on the side of the circulating path 110 (on the upstream side). Such a function of the booster pump 4 is attained by changing the opening of a variable blade, the number of rotations, etc.

Figure 2:
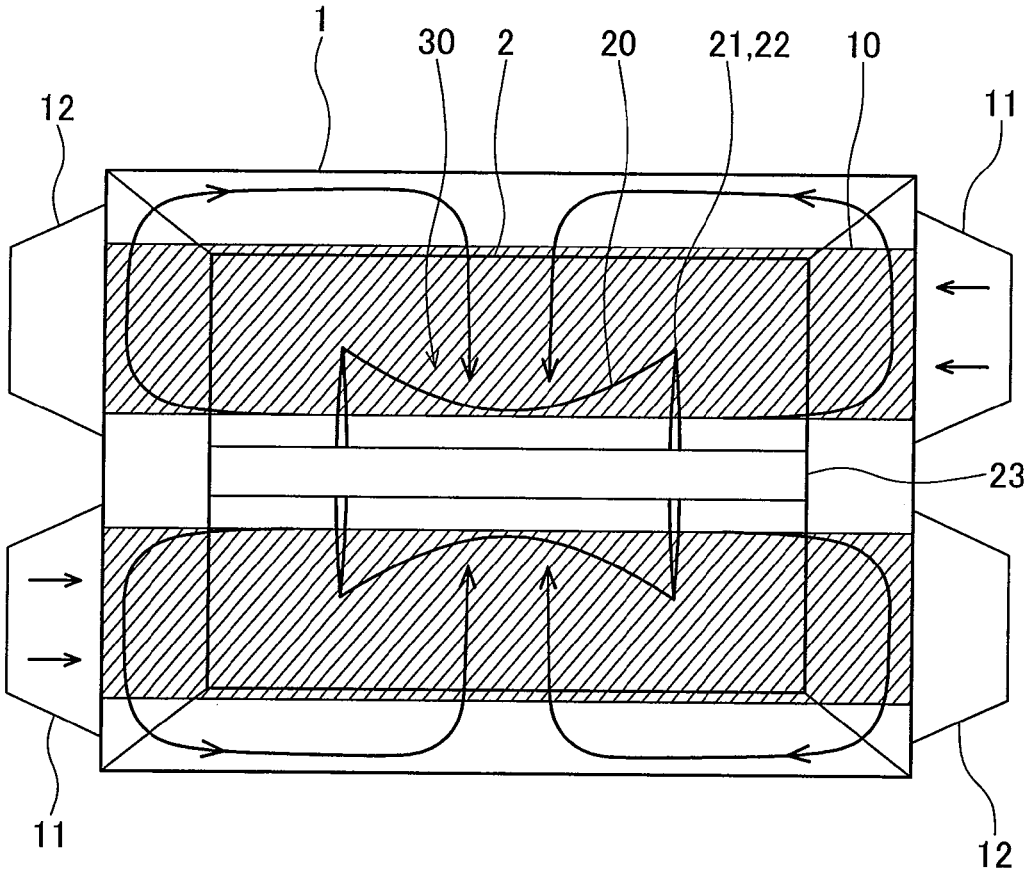
FIG. 2 is a top view of the condenser according to the first embodiment of the present invention.

The internal configuration of the condenser 1 will be explained below with reference to FIGS. 2 and 3. FIG. 2 is a top view of the condenser 1, and FIG. 3 an elevational view thereof. The same reference numerals as in FIG. 1 denote identical parts, and duplication explanations will be omitted (this also applies to subsequent diagrams).

A low pressure turbine exhaust hood 2 is connected to the condenser 1. The low pressure turbine exhaust hood 2 is provided with a casing 20 connected with a steam inlet 25 (refer to FIG. 1). A low pressure turbine 30 is disposed in the casing 20.

The low pressure turbine 30 includes a rotor 23 which is rotated by steam introduced from the steam entrance 25. The rotor 23 is provided with a turbine bucket. A flow path for distributing steam is formed between the rotor 23 and the casing 20. A final stage bucket 21 is provided at an end of the flow path. An exhaust area 22 is formed around the final stage bucket 21. The exhaust area 22 discharges steam that has rotatably driven the low pressure turbine 30. This steam is condensed with the cooling water flowing in the tube nest 10.

Figure 3:
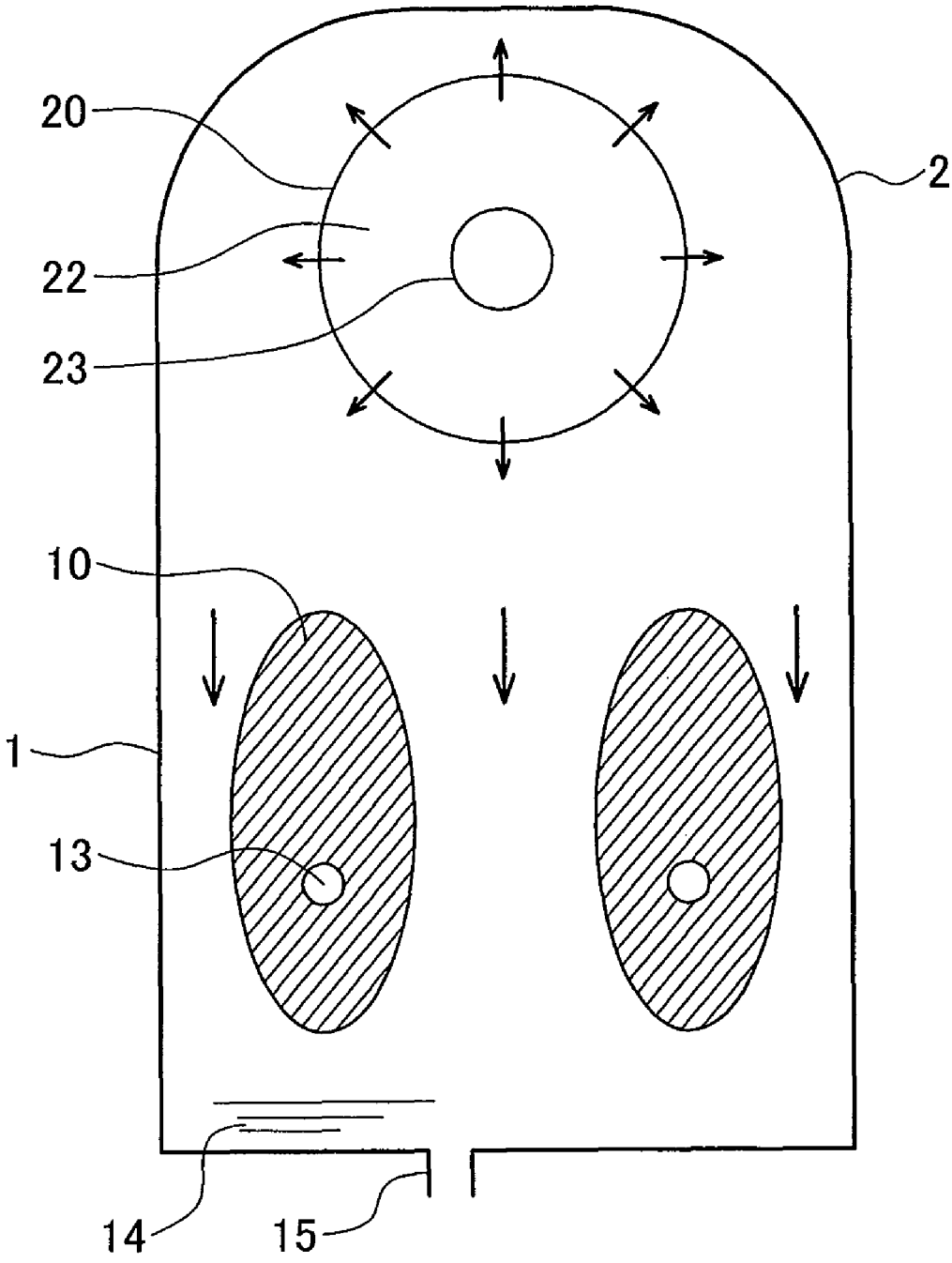
FIG. 3 is an elevational view of the condenser according to the first embodiment of the present invention.

Referring to FIG. 3, the tube nest 10 includes an air exhaust port 13. Air and non-condensed steam are exhausted from the air exhaust port 13. Condensed liquid condensed by the tube nest 10 drops in a condensed liquid reservoir 14, and is then discharged through a condensed liquid exit 15 connected to the bottom portion of the condenser 1. As shown in FIGS. 2 and 3, the condenser 1 according to the present embodiment includes a pair of tube nests 10. The bypass tube 50 and the recirculating path 40 are connected to each of the circulating path 110 and discharge path 120 connected to each tube nest 10. The number of tube nests 10 is not limited to two as shown above, but may be one, three, and above. Although the cooling water is flowing in the two tube nests 10 in opposite directions, the cooling water may be made to flow in the same direction.

Operation of the condenser 1 according to the thus-configured present embodiment will be explained below.

Referring to FIG. 1 again, the condenser 1 has a steam temperature Ts. When steam is saturated in the condenser 1 and the steam temperature is settled, the saturation steam pressure, i.e., the vacuum in the condenser 1 (condenser vacuum) will be settled. Here, a steam temperature at which the vacuum in the condenser 1 is set to an optimal vacuum is referred to as optimal steam temperature. Let the optimal steam temperature be Tso. As shown in FIG. 1, cooling water at temperature Tc flows at a flow rate Qc at an upstream point F1 in the circulating path 110; cooling water at temperature Tc' flows at a flow rate Qc' at a point F2 immediately before the tube nest 10; cooling water at temperature Td' flows at a flow rate Qc' at a point F3 immediately after the tube nest 10; and cooling water at temperature Td flows at a flow rate Qc at a downstream point F4 in the circulating path 120. Further, in the tube nest 10, cooling water at temperature Tc'(x) flows at a point (F(x)) where x is a distance along the cooling-water flow from the point F2 (Tc'(0)=Tc').

Figure 4:
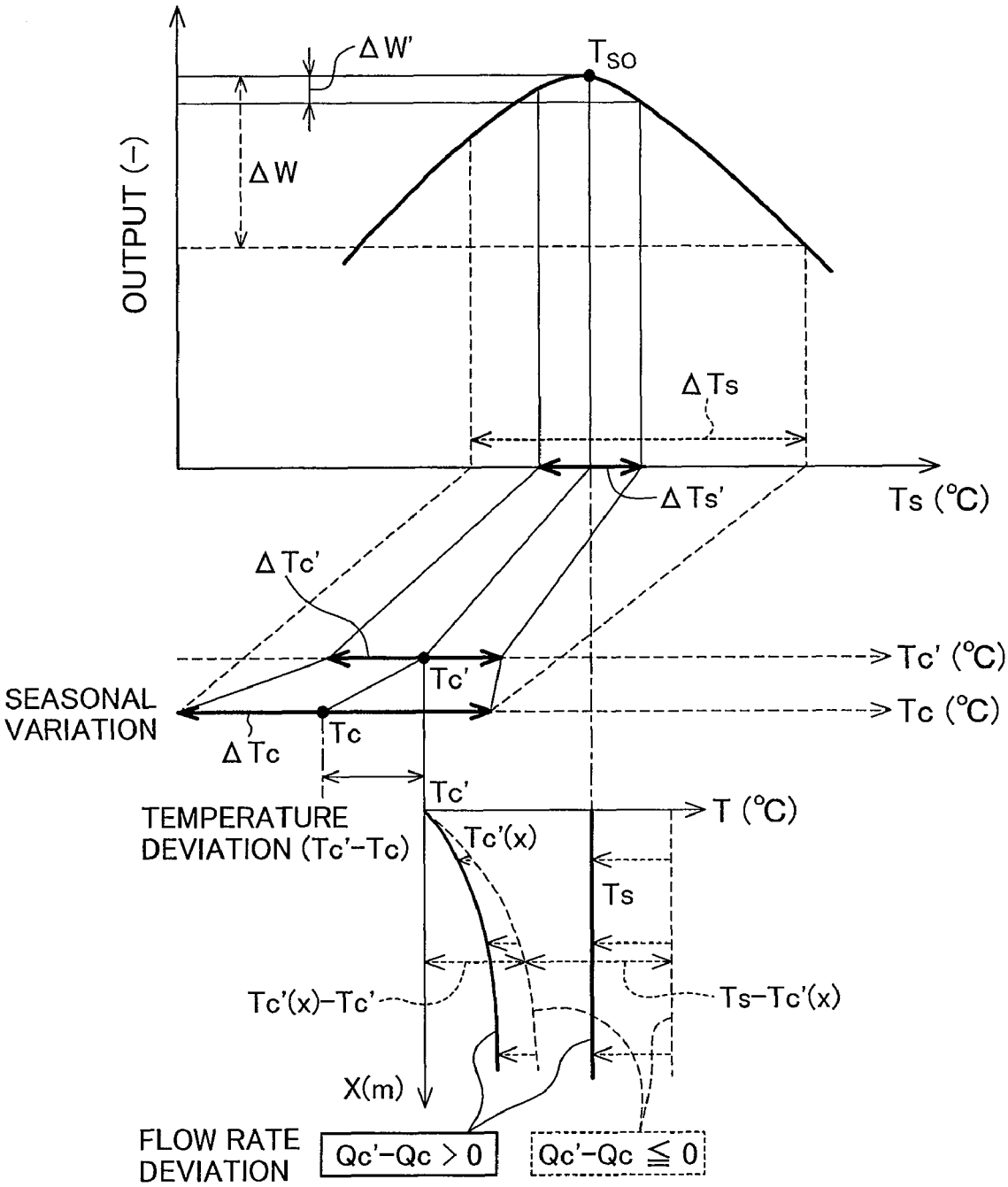
FIG. 4 is a diagram showing a relation between cooling-water temperatures Tc and Tc', steam temperature Ts, and output W of a power plant including the condenser according to the first embodiment of the present invention.

Generally, when the cooling-water temperature (Tc) in the water source changes, the cooling-water temperature (Tc') at a point immediately before the cooling water flows in the tube nest 10 also changes. Accordingly, the steam temperature Ts changes. Therefore, under an environment where the cooling-water temperature changes, it is difficult to maintain the optimal steam temperature Tso and therefore the output W of the power plant is likely to fluctuate. Specifically, as shown in FIG. 4 (to be mentioned later), a cooling-water temperature change ⊿Tc causes a steam temperature change ⊿Ts, resulting in an output variation ⊿W of the power plant.

On the other hand, when the temperature Tc of the cooling water in the water source changes, the temperature Tc' and/or the flow rate Qc' of the cooling water flowing at the point F2 according to the present embodiment is deviated respectively from the temperature Tc and/or the flow rate Qc of the cooling water flowing at the point F1 by the control valve 5 and the booster pump 4. In other words, the temperature Tc' and the flow rate Qc' of the cooling water flowing at the point F2 according to the present embodiment are controlled by the control valve 5 and the booster pump 4 so that the steam temperature Ts is brought close to the optimal steam temperature Tso. For example, when the control valve 5 is opened, part of the cooling water from the water source is supplied directly to the discharge path 120, without being supplied to the tube nest 10. Therefore, the cooling water at the point F2 can be deviated mainly in flow rate from the cooling water at the point F1. On the other hand, when the booster pump 4 is operated, part of the cooling water heated by the tube nest 10 is recirculated to the circulating path 110. Therefore, the cooling water at the point F2 can be deviated in temperature and flow rate from the cooling water at the point F1.

In this way, the temperature Tc' and the flow rate Qc' of the cooling water at the point F2 are controlled by the control valve 5 and the booster pump 4. Thus the steam temperature Ts can be brought close to the optimal steam temperature Tso while maintaining constant both the flow rate (Qc) at which cooling water is taken from the water source through the circulating path 110 and the water temperature (Td) at which cooling water is discharged to the water source through the discharge path 120.

The following explains an effect of the cooling water controlled to the temperature Tc' and the flow rate Qc' at the point F2 on the steam temperature Ts.

FIG. 4 is a diagram showing a relation between the cooling-water temperature (Tc, Tc'), the steam temperature (Ts), and the output (W) of the power plant including the condenser 1 according to the present embodiment.

The graph at the top of FIG. 4 shows a relation between the steam temperature Ts and the output W of the power plant. As shown by the output curve in FIG. 4, the output W depends on the steam temperature Ts which defines the vacuum of the condenser 1. Specifically, the output W reaches a peak at the optimal vacuum, the optimal steam temperature Tso, and decreases as the temperature separates from Tso.

In accordance with the present embodiment, when the cooling-water temperature Tc changes, the cooling-water temperature Tc' is controlled so as to be deviated from the cooling-water temperature Tc by the control valve 5 and the booster pump 4. By controlling the temperature Tc' of the cooling water in this way, a temperature fluctuation range ⊿Tc' of the cooling water can be made smaller than a cooling-water temperature change ⊿Tc, as shown in the middle of FIG. 4. Since a fluctuation range of Ts, ⊿T's, also decreases accordingly, the output difference ⊿W can be reduced. In a specific example, it is requested in some cases that the temperature of the cooling water in the circulating path 110 be controlled with its flow rate maintained constant in order to prevent adhesion of dirt to the inner surface of the tube. In this case, the temperature deviation can be increased with a constant flow rate maintained by circulating the same quantity of the cooling water in the bypass tube 50 and the recirculating path 40.

Further, the present embodiment controls not only the cooling-water temperature Tc' but also the flow rate Qc' of the cooling water deviated from the flow rate Qc. Similar to the temperature Tc' of the cooling water, the flow rate Qc' is also controlled by the control valve 5 and the booster pump 4.

The graph shown at the bottom of FIG. 4 shows a relation between the temperature Tc'(x) of the cooling water and the steam temperature Ts in the tube nest 10. As shown in this graph, when the flow rate Qc' of the cooling water at the point F2 is made larger than Qc (that is, Qc'−Qc>0), the following two advantages result: Firstly, it becomes easier to reduce the rise of the temperature Tc'(x) of the cooling water in the tube nest 10 to lower the average temperature (that is, bring it close to Tc') in comparison with the case of "Qc'−Qc≦0." Secondly, since the flow rate of the cooling water increases, the coefficient of heat transmission increases. Accordingly, it becomes easier to lower the steam temperature Ts (that is, bring it close to the average temperature of the cooling-water temperature Tc'(x)) in comparison with the case of "Qc'−Qc≦0." Further, when the flow rate is deviated in the present embodiment, there is an opposite effect that the cooling-water temperature Tc' at the point F2 is raised. However, when a difference between the cooling-water temperature and the steam temperature (Ts−Tc'(x)) is larger than the cooling-water temperature rise (Tc'(x)−Tc'), an increase in the coefficient of heat transmission lowers the steam temperature Ts and increases the vacuum. Therefore, when the steam temperature Ts is higher than the optimal steam temperature Tso, the steam temperature Ts can be brought close to Tso by making Qc' larger than Qc. On the contrary, when the steam temperature Ts is lower than the optimal steam temperature Tso, the steam temperature Ts can be brought close to Tso by making Qc' smaller than Qc. Since the fluctuation range of the steam temperature (initially ⊿Ts) can be decreased to ⊿Ts', the output variation ⊿W can be decreased to ⊿W'.

As mentioned above, the present embodiment makes it possible to change the temperature Tc' and the flow rate Qc' of the cooling water at the point F2 by the use of the control valve 5 and the booster pump 4 while maintaining constant the flow rate (Qc) taken from the water source and the discharge temperature (Td) of the water discharged thereto. This configuration makes it possible to reduce the steam temperature change ⊿Ts, thus restraining the output variation ⊿W of the power plant.

With the present embodiment, as shown in FIG. 4, it is desirable to configure the condenser 1 such that the optimal steam temperature Tso is included in the range ⊿Ts' over which the steam temperature Ts changes as the steam in the condenser 1 is cooled by the tube nest 10. (In other words, it is desirable to configure the condenser 1 such that the range over which the steam temperature Ts fluctuates includes a point at which the vacuum in the condenser 1 reaches the optimal vacuum). When the condenser is configured in this way, the fluctuation range of the output can be controlled while the maximum output of the power plant is maintained. This configuration also makes it possible to apply a design different from that based on a conventional scheme as shown below.

As shown in a reference (Report of Subcommittee on the Safety of Nuclear Reactors, Nuclear Safety Meeting, "Safety in Operation with Constant Rated Thermal Output": pp. 2, FIG. 2, (Dec. 7, 2001)), a power plant provided with a steam turbine is normally planned to provide a peak output in the winter season during which the circulating-water temperature is low.

Although it is necessary to increase the cooling area in the condenser in order to increase the vacuum of the condenser, the power obtained does not increase if the vacuum is increased too much, as mentioned earlier. On the contrary, the condensed liquid temperature falls and more heat is required to reheat it, resulting in output reduction. For this reason, it is thought reasonable to a certain extent to plan a power plant so as to provide a peak output in the winter season aiming at reducing cost and maximizing the output.

Unlike the conventional scheme, the present embodiment makes it possible to bring a peak of the output curve, at which the steam temperature Ts reaches the optimum steam temperature Tso shown in FIG. 4, close to the summer season during which the cooling-water temperature Tc of the water source is high. One method for shifting a peak of the output curve in this way is, for example, to increase the cooling area of the condenser. When the cooling-water temperature Tc falls because of seasonal variation, it is preferable to mix the cooling water heated by tube nest 10 into the circulating path 110 through the recirculating path 40 to improve the cooling-water temperature Tc' at the entrance of the tube nest 10. This configuration of the condenser 1 makes it possible to operate the power plant in the vicinity of the maximum output with output fluctuations restrained.

A second embodiment of the present invention will be explained below.

Figure 5:
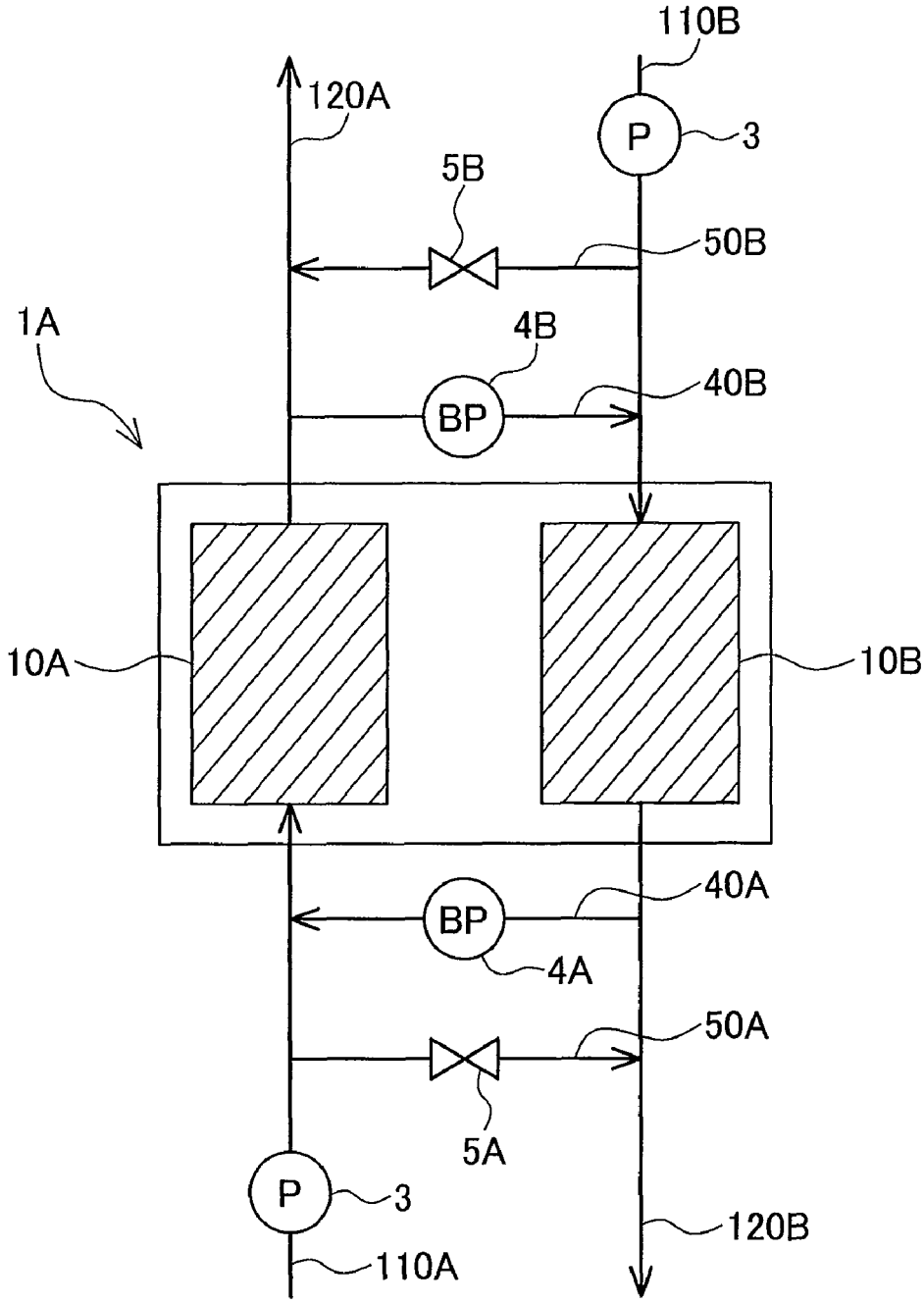
FIG. 5 shows the general configuration of a condenser according to a second embodiment of the present invention.

FIG. 5 is the general configuration of a condenser according to the second embodiment of the present invention.

A condenser 1A according to the present embodiment differs from the condenser 1 according to the first embodiment in that cooling water is exchanged between two tube nests 10A and 10B.

Referring to FIG. 5, the condenser 1A includes a first tube nest 10A, a second tube nest 10B, a first circulating path 110A, a second circulating path 110B, a first discharge path 120A, a second discharge path 120B, a first bypass tube 50A, a second bypass tube 50B, a first control valve 5A, a second control valve 5B, a first recirculating path 40A, a second recirculating path 40B, a first booster pump 4A, and a second booster pump 4B.

The first and second tube nests 10A and 10B are included in the condenser 1. The first circulating path 110A and the first discharge path 120A are connected to the first tube nest 10A. Likewise, the second circulating path 110B and the second discharge path 120B are connected to the second tube nest 10B. Each of the first and second circulating paths 110A and 110B is provided with a feed pump 3 for pumping up cooling water from the water source. The first bypass tube 50A and the first recirculating path 40A are provided to bridge between the first circulating path 110A and the second discharge path 120B. Likewise, the second bypass tube 50B and the second recirculating path 40B are provided to bridge between the second circulating path 110B and the first discharge path 120A. The first bypass tube 50A is provided with the first control valve 5A. The first recirculating path 40A is provided with the first booster pump 4A. The second bypass tube 50A is provided with the second control valve 5B. The second recirculating path 40B is provided with the second booster pump 4B.

With the present embodiment, the flow rate of the cooling water in the first and second bypass tubes 50A and 50B is identically controlled by the first and second control valves 5A and 5B, respectively. Likewise, the flow rate of the cooling water in the first and second recirculating paths 40A and 40B is identically controlled by the first and second booster pumps 4A and 4B, respectively. Controlling the flow rate of the cooling water in this way makes it possible to provide an equivalent cooling capability of the first and second tube nests 10A and 10B.

With the present embodiment, the first recirculating path 40A is provided to bridge between the first circulating path 110A and the second discharge path 120B such that the first recirculating path 40A is closer to the first and second tube nests 10A and 10B than the first bypass tube 50A. Likewise, the second recirculating path 40B is provided to bridge between the first discharge path 120A and the second circulating path 110B such that the first recirculating path 40B is closer to the first and second tube nests 10A and 10B than the second bypass tube 50B. As is the case with the example explained according to the first embodiment, this configuration makes it possible to efficiently utilize the heat of the cooling water heated by steam.

The configuration of the condenser 1A according to the present embodiment also makes it possible to control the temperature and flow rate of the cooling water flowing in each of the tube nests 10A and 10B while maintaining constant the quantity of water taken from the water source and the discharge temperature of water discharged thereto. Therefore, as is the case with the first embodiment, it is possible to reduce the output variation $\Delta W$ of the power plant even when the cooling-water temperature in the water source changes.

Although a condenser having a pair of tube nests has been explained with the present embodiment, it is needless to say that a condenser having more number of tube nests can be applied. Further, with the present embodiment, although the cooling water flows in opposite directions in the tube nests 10A and 10B, it is possible that the cooling water flows in the same direction therein.

A third embodiment of the present invention will be explained below.

Figure 6:
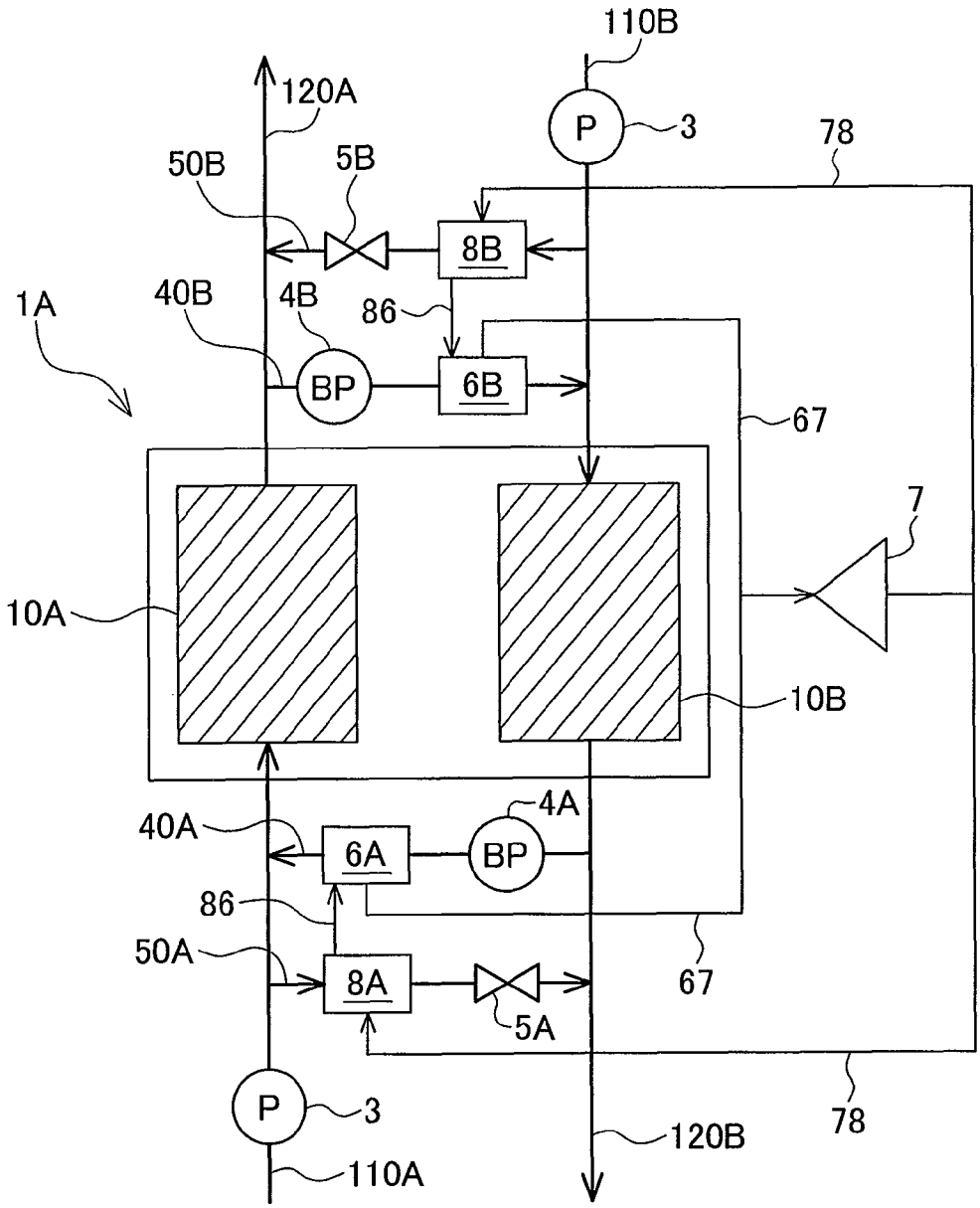
FIG. 6 shows the general configuration of a power generating installation according to a third embodiment of the present invention.

FIG. 6 is the general configuration of a power generating installation according to the third embodiment of the present invention.

The power generating installation shown in FIG. 6 includes the condenser 1A explained in the second embodiment, a turbine 7, a first condenser 8A, a second condenser 8B, a first evaporator 6A, and a second evaporator 6B.

The turbine 7 is driven by a condensable fluid having a larger saturated steam density than the steam from the low pressure turbine 30. The first condenser 8A is provided on the upstream side of the first control valve 5A in the first bypass tube 50A so as to condense the condensable fluid from the turbine 7 with cooling water. Likewise, the second condenser 8B is provided on the upstream side of the second control valve 5B in the second bypass tube 50B so as to condense the condensable fluid from the turbine 7 with cooling water. The first evaporator 6A is provided on the downstream side of the first booster pump 4A in the first recirculating path 40A so as to evaporate the condensable fluid from the first condenser 8A with cooling water and supply the steam to the turbine 7. Likewise, the second evaporator 6B is provided on the downstream side of the second booster pump 4B in the second recirculating path 40B so as to evaporate the condensable fluid from the second condenser 8B with cooling water and supply the steam to the turbine 7.

With this configuration, a heat cycle is formed by a condensable fluid having a larger saturated steam density than steam, i.e., the working fluid of the low pressure turbine 30 (steam turbine power plant). Examples of condensable fluids having a larger saturated steam density than steam include ammonia, chlorofluorocarbon, etc. used for ocean-thermal energy conversion generation and the like. The use of a fluid having a larger saturated steam density than steam makes it possible to configure a power generating installation which is smaller than a steam turbine power plant.

In the thus-configured power generating installation, the evaporators 6A and 6B heat the condensable fluid supplied from the condensers 8A and 8B, respectively, to generate steam with the cooling water (hot heat source) discharged from the tube nests 10A and 10B, respectively. The steam generated in this way is supplied to the turbine 7 through steam tubes 67, which connects the turbine 7 with the evaporators 6A and 6B, to rotate the turbine 7. The steam that has passed through the turbine 7 is sent to the condensers 8A and 8B through steam tubes 78 which connect the condensers 8A and 8B with the turbine 7. The steam sent to the condensers 8A and 8B is cooled and condensed with the cooling water (cold heat source) flowing in the bypass tubes 50A and 50B, respectively. The thus-obtained condensed liquid is discharged by a pump (not shown) and then supplied respectively to the evaporators 6A and 6B.

Thus, the present embodiment makes it possible to obtain an output of power generation by the turbine 7 by utilizing the temperature difference between the cooling water flowing in the bypass tubes 50A and 50B and the cooling water flowing in the recirculating paths 40A and 40B, respectively. Accordingly, an output due to the condensable fluid can be obtained in addition to an output increase obtained by controlling the temperature and flow rate of the cooling water in the condenser 1A, thus further improving the entire output of the power plant. Further, with the present embodiment, the lower the cooling-water temperature (Tc) in the water source is, the larger becomes the temperature difference between the cooling water flowing in the bypass tubes 50A and 50B and the cooling water flowing in the recirculating paths 40A and 40B, respectively, and accordingly the larger output of power generation can be obtained.

Although an exemplary power generating installation using the condenser 1A according to the second embodiment has been explained with the present embodiment, an output of power generation can be obtained also by the condenser 1 according to the first embodiment.

A fourth embodiment of the present invention will be explained below.

Figure 7:
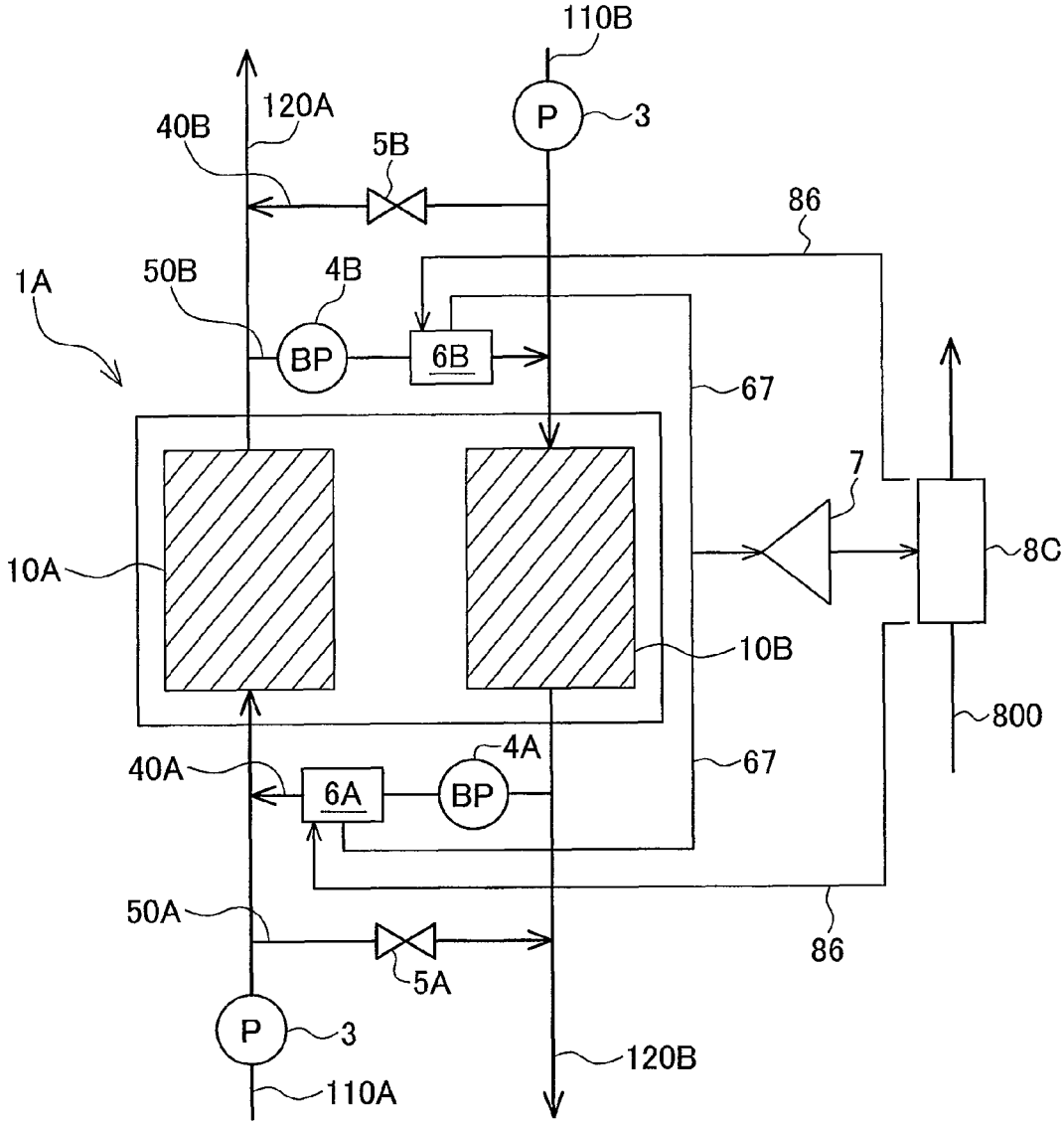
FIG. 7 shows the general configuration of a power generating installation according to a fourth embodiment of the present invention.

FIG. 7 is the general configuration of a power generating installation according to the fourth embodiment of the present invention.

The power generating installation shown in FIG. 7 includes the condenser 1A, the turbine 7, a condenser 8C, the first evaporator 6A, and the second evaporator 6B.

The condenser 8C condenses the condensable fluid from the turbine 7 by use of a cold heat source having a lower temperature than the temperature Tc in the water source of the cooling water of the condenser 1A. A cold heat source tube 800 for distributing the cold heat source extends through the condenser 8C. The condenser 8C is connected to the first and second evaporators 6A and 6B through condensed liquid tubes 86. The deep ocean water whose temperature is 4° C. or a liquefied natural gas can be used as the cold heat source flowing in the condenser 8C, for example.

The thus-configured power generating installation also can rotate the turbine 7 with a condensable fluid and therefore improve the output of the power plant as is the case with the third embodiment. In particular, unlike the third embodiment, the present embodiment has the following features.

Figure 8:
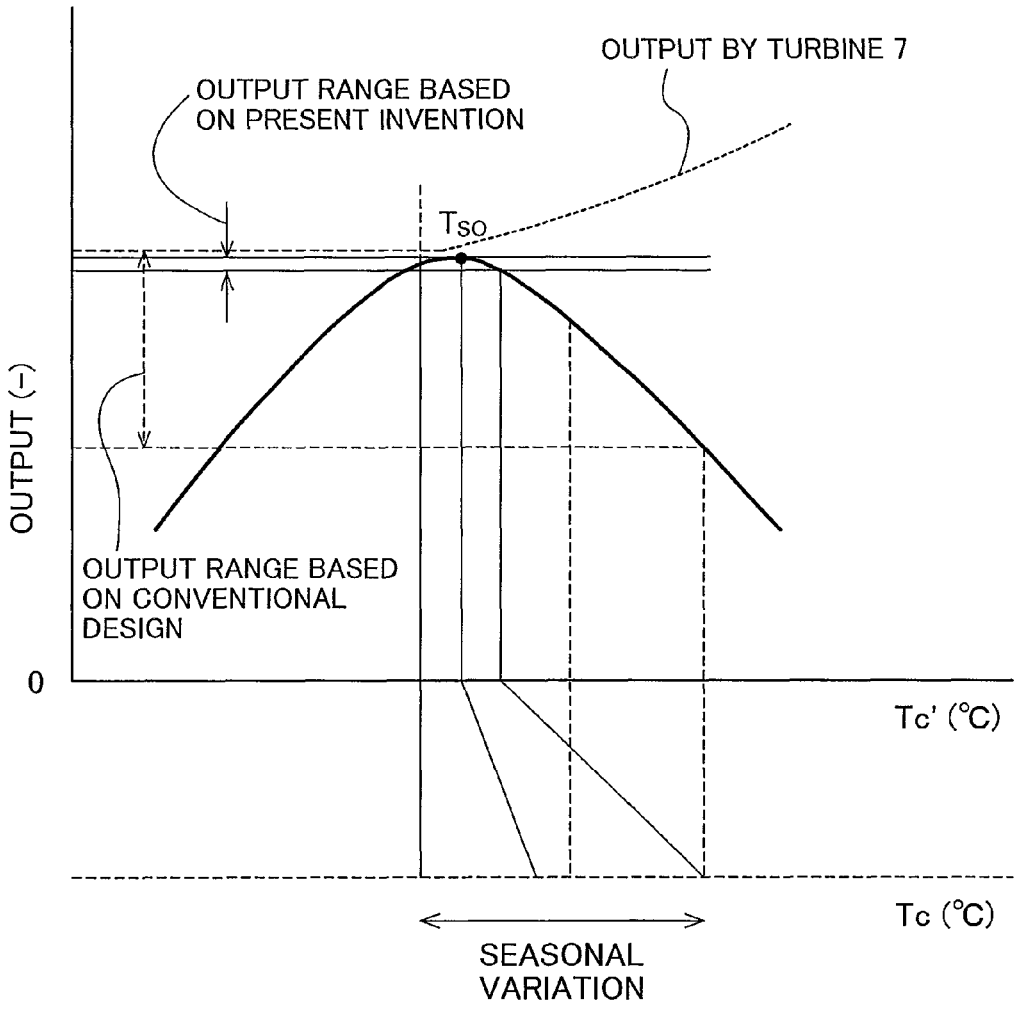
FIG. 8 shows an output curve of a power plant having the power generating installation according to the fourth embodiment of the present invention.

FIG. 8 shows an output curve of a power plant having the power generating installation according to the present invention. Unlike FIG. 4, FIG. 8 shows a relation between the output W and the cooling-water temperature Tc'. FIG. 8 also shows an effect of steam temperature fall by an increase in the flow rate of the cooling water converted into an effect of steam temperature fall by cooling-water temperature fall.

With the present embodiment, the temperature of the cooling water introduced to the tube nests 10A and 10B through the recirculating paths 40A and 40B, respectively, is lower than the temperature of the cooling water introduced directly from the water source thereto through the circulating paths 110A and 110B, respectively. Therefore, it is desirable to provide the optimal steam temperature Tso, at which the output curve reaches a peak, in the winter season during which the cooling-water temperature Tc of the water source is low. In accordance with the present embodiment, since low-temperature cooling water can be supplied from the recirculating paths 40A and 40B to the tube nests 110A and 110B, respectively, even when the cooling-water temperature Tc rises in the summer season or the like, the cooling-water temperature Tc' can be constantly maintained low. Accordingly, the output of the power plant can be brought close to the peak of the output curve, thus improving output of the power generation.

Although an exemplary power generating installation using the condenser 1A according to the second embodiment has been explained with the present embodiment, it is needless to say that an output of power generation can be obtained also by the condenser 1 according to the first embodiment.

What is claimed is:

1. A condenser used for a steam turbine power plant, comprising:

a circulating path through which cooling water taken from a water source flows;

a tube nest including a plurality of cooling tubes through which the cooling water coming from the circulating path flow, the tube nest condensing steam supplied from a steam turbine with the cooling water in the plurality of cooling tubes;

a discharge path through which the cooling water discharged from the tube nest flows;

a bypass tube disposed to bridge between the circulating path and the discharge path;

flow rate control means disposed in the bypass tube for controlling the flow rate of the cooling water supplied from the circulating path to the discharge path;

a recirculating path disposed to bridge between the discharge path and the circulation path; and boosting means disposed in the recirculating path for controlling the flow rate of the cooling water supplied from the discharge path to the circulating path;

wherein, when a water temperature in the water source changes, at least one of the temperature and the flow rate of the cooling water to flow through the tube nest is deviated from the temperature and the flow rate of the cooling water coming from the water source by the flow rate control means and the boosting means, wherein the flow rate at which the cooling water taken from the water source flows through the circulating path is maintained at a predetermined value.

2. The condenser according to claim 1, wherein the temperature and flow rate of the cooling water to flow through the tube nest are controlled by the flow rate control means and the boosting means so that the steam temperature in the condenser is brought close to a value at which the output of the steam turbine power plant is maximized.

3. The condenser according to claim 1, wherein an optimal steam temperature, at which the steam turbine generates maximum output, is included in a temperature range over which steam temperature changes as steam in the condenser is cooled by the tube nest.

4. The condenser according to claim 1, wherein the recirculating path is disposed to bridge between the circulating path and the discharge path such that the recirculating path is closer to the tube nest than the bypass tube.

5. The condenser according to claim 1, wherein the tube nest is formed of a plurality of tube nests; and wherein each of the plurality of tube nests is connected with the circulating path and the discharge path.

6. The condenser according to claim 1, the boosting means boosts the cooling water on the side of the discharge path to the pressure on the side of the circulating path.

7. A condenser used for a steam turbine power plant comprising:

a circulating path through which cooling water taken from a water source flows;

a tube nest including a plurality of cooling tubes through which the cooling water coming from the circulating path flow, the tube nest condensing steam supplied from a steam turbine with the cooling water in the plurality of cooling tubes;

a discharge path through which the cooling water discharged from the tube nest flows;

a bypass tube disposed to bridge between the circulating path and the discharge path;

flow rate control means disposed in the bypass tube for controlling the flow rate of the cooling water supplied from the circulating path to the discharge path;

a recirculating path disposed to bridge between the discharge path and the circulation path; and boosting means disposed in the recirculating path for controlling the flow rate of the cooling water supplied from the discharge path to the circulating path;

wherein, when a water temperature in the water source changes, at least one of the temperature and the flow rate of the cooling water to flow through the tube nest is deviated from the temperature and the flow rate of the cooling water coming from the water source by the flow rate control means and the boosting means, wherein the tube nest is formed of a pair of two tube nests each having a circulating path through which cooling water taken from the water source flows and a discharge path through which cooling water heated by steam flows, wherein the bypass tube includes a first bypass tube for bypassing the cooling water of the circulating path of a first tube nest of the two tube nests to the discharge path of a second tube nest thereof, and a second bypass tube for bypassing the cooling water of the circulating path of the second tube nest to the discharge path of the first tube nest, wherein the flow rate control means includes first flow rate control means disposed in the first bypass tube for controlling the flow rate of the cooling water supplied from the circulating path of the first tube nest to the discharge path of the second tube nest, and second flow rate control means disposed in the second bypass tube for controlling the flow rate of the cooling water supplied from the circulating path of the second tube nest to the discharge path of the first tube nest, wherein the recirculating path includes a first recirculating path used for returning the cooling water of the discharge path of the second tube nest to the circulating path of the first tube nest, and a second recirculating path used for returning the cooling water of the discharge path of the first tube nest to the circulating path of the second tube nest, wherein the boosting means includes first boosting means disposed in the first recirculating path for controlling the flow rate of the cooling water supplied from the discharge path of the second tube nest to the circulating path of the first tube nest, and second boosting means disposed in the second recirculating path for controlling the flow rate of the cooling water supplied from the discharge path of the first tube nest to the circulating path of the second tube nest, and wherein any one of the temperature, the flow rate and both the temperature and the flow rate of the cooling water to flow through the two tube nests is deviated from the temperature and the flow rate of the cooling water from the water source by the first flow rate control means, the second flow rate control means, the first boosting means, and the second boosting means.

8. The condenser according to claim 7, wherein the flow rate of the cooling water in the first and second bypass tubes is identically controlled by the first and second flow rate control means, respectively; and wherein the flow rate of the cooling water in the first and second recirculating paths is identically controlled by the first and second boosting means, respectively.

9. A power generating installation comprising, a condenser including:

a circulating path through which cooling water taken from a water source flows;

a tube nest including a plurality of cooling tubes through which the cooling water coming from the circulating path flow, the tube nest condensing steam supplied from a steam turbine with the cooling water in the plurality of cooling tubes;

a discharge path through which the cooling water discharged from the tube nest flows;

a bypass tube disposed to bridge between the circulating path and the discharge path;

flow rate control means disposed in the bypass tube for controlling the flow rate of the cooling water supplied from the circulating path to the discharge path;

a recirculating path disposed to bridge between the discharge path and the circulation path; and boosting means disposed in the recirculating path for controlling the flow rate of the cooling water supplied from the discharge path to the circulating path;

a turbine driven by a condensable fluid having a larger saturated steam density than steam introduced into the condenser;

a cold heat source condenser for condensing the condensable fluid from the turbine; and an evaporator disposed on the downstream side of the boosting means in the recirculating path for evaporating the condensable fluid from the cold heat source condenser with cooling water to supply steam to the turbine;

wherein the temperature and/or the flow rate of the cooling water flowing in the two tube nests is deviated respectively from the temperature and/or the flow rate of the cooling water on the upstream side of the circulating path by the flow rate control means and the boosting means, wherein the flow rate at which the cooling water taken from the water source through the circulating path is maintained at a predetermined value.

10. The power generating installation according to claim 9, wherein the cold heat source condenser is disposed on the upstream side of the flow rate control means in the bypass tube to condense the condensable fluid from the turbine with cooling water.

11. The power generating installation according to claim 9, wherein the cold heat source condenser condenses the condensable fluid from the turbine by use of a cold heat source having a lower temperature than the water source of the cooling water of the condenser.

12. The power generating installation according to claim 11, wherein the cold heat source of the cold heat source condenser is deep ocean water or a liquefied natural gas.

13. The power generating installation according to claim 9, wherein the condensable fluid is ammonia or chlorofluorocarbon.

14. The condenser according to claim 1, wherein the water temperature at which cooling water is discharged to the water source through the discharge path is maintained at a predetermined value.

15. The power generating installation according to claim 9, wherein the water temperature at which cooling water is discharged to the water source through the discharge path is maintained at a predetermined value.

16. The condenser according to claim 7, wherein the flow rate at which the cooling water taken from the water source flows through the circulating path is maintained at a predetermined value.

* * * * *